US005899103A

United States Patent [19]

Ooenoki et al.

[11] Patent Number: 5,899,103

[45] Date of Patent: May 4, 1999

[54] BENDING MACHINE

[75] Inventors: Toshiyuki Ooenoki; Toshiro Otani, both of Osaka, Japan

[73] Assignee: Komatsu, Ltd, Tokyo, Japan

[21] Appl. No.: 08/913,851

[22] PCT Filed: Apr. 19, 1996

[86] PCT No.: PCT/JP96/01060

§ 371 Date: Sep. 26, 1997

§ 102(e) Date: Sep. 26, 1997

[87] PCT Pub. No.: WO96/33824

PCT Pub. Date: Oct. 31, 1996

[30] Foreign Application Priority Data

Apr. 27, 1995 [JP] Japan ..... 7-104223

[51] Int. Cl.[6] ..... B21D 5/02

[52] U.S. Cl. ..... 72/31.1; 72/389.5

[58] Field of Search ..... 72/31.1, 31.11, 72/389.1, 389.5

[56] References Cited

U.S. PATENT DOCUMENTS

| | | | |
|---|---|---|---|
| 5,060,495 | 10/1991 | Naoomi et al. | 72/31.1 |
| 5,062,283 | 11/1991 | Miyagawa et al. | 72/31.1 |

FOREIGN PATENT DOCUMENTS

| | | | |
|---|---|---|---|
| 58-184019 | 10/1983 | Japan . | |
| 59-174221 | 10/1984 | Japan . | |
| 59-225818 | 12/1984 | Japan . | |
| 60-17610 | 5/1985 | Japan . | |
| 60-47017 | 10/1985 | Japan . | |
| 62-224426 | 10/1987 | Japan . | |
| 1-228612 | 9/1989 | Japan . | |
| 3-53046 | 8/1991 | Japan . | |
| 4-108917 | 9/1992 | Japan . | |
| 4-251614 | 9/1992 | Japan . | |
| 5-138253 | 6/1993 | Japan . | |
| 5-322551 | 12/1993 | Japan . | |
| 5-337554 | 12/1993 | Japan | 72/389.5 |
| 5-337555 | 12/1993 | Japan . | |
| 6-54416 | 7/1994 | Japan . | |
| 7-32044 | 2/1995 | Japan . | |
| 8-300047 | 11/1996 | Japan . | |

*Primary Examiner*—David Jones
*Attorney, Agent, or Firm*—Nikaido Marmelstein Murray & Oram, LLP

[57] ABSTRACT

The angle of bend is detected at a plurality of points in a workpiece by angle detecting units during bending of the workpiece. Based on the difference between the bend angle detected at each point and a target bend angle for the workpiece, ball screws are controlled so as to deform a bed for supporting an upper die or lower die, thereby compensating for the boat form of the workpiece.

10 Claims, 9 Drawing Sheets

BENDING MACHINE

TECHNICAL FIELD

The present invention relates to a bending machine and more particularly to a bending machine of the type in which a sheet-like workpiece is bent to a desired angle by utilizing the relative movement of the upper die and lower die.

BACKGROUND ART

In a prior art bending machine such as a press brake, a sheetlike workpiece is placed between the upper and lower dies and the movable ram is operated to lower the upper die or lift the lower die thereby pressing the workpiece between these dies to perform a desired bending operation. When such a bending machine is used to bend an elongate workpiece so as form a bending line extending in a direction parallel to the longitudinal direction of the workpiece, there arises the problem of so-called "boat form", that is, the workpiece being less deeply bended at the central area of the bending line than at both end areas, as shown in FIG. 8.

The following are the chief causes of "boat form".

(1) The workpiece varies in physical characteristics (e.g., sheet thickness) from position to position in the longitudinal direction of the workpiece.

(2) Since the movable ram is stressed at both ends, the machine itself is resiliently deformed. This leads to a non-uniform stress distribution in which stress varies from position to position in the bending line of the workpiece.

There have been proposed several correction mechanisms in an attempt to prevent the occurrence of boat form. Typical of these correction mechanisms are disclosed in the following publications.

(1) Japanese Patent Publication No. 60-17610 (1985)

By inserting wedge-like keys above the upper die or under the lower die, the upper die and lower die are made close to each other in the areas corresponding to the areas of the workpiece where imperfect bending is likely to occur.

(2) Japanese Utility Model Laid-Open Publication No. 6-54416 (1994)

There are provided at least three driver units for lifting and lowering the ram and a deflection detector for detecting the deflection amount of the ram. A value of deflection detected by the deflection detector is fed back to a controller to control the middriver unit.

(3) Japanese Patent Publication No. 3-53046 (1991)

Each end of the movable apron is provided with a hydraulic cylinder for lifting and lowering the movable apron. The fixed apron or movable apron is provided at almost the center with a hydraulic cylinder for correcting the deflection of the apron. Based on the pressure of the lifting hydraulic cylinder and on the length of the workpiece, the amount of pressure oil to be supplied to the deflection-correcting hydraulic cylinder is controlled.

The first correction method (1) was found to be unsuitable for bending particularly an elongate workpiece because it has difficulty in carrying out bend angle detection along the longitudinal direction of the workpiece. In addition, even if a correction amount for the bend angle at each detecting point can be obtained from the result of inspection, correction can be rarely done by one step but a sequence of steps (i.e., trial bending→inspection →correction) must be repeated. Moreover, such a sequence of steps need to be carried out whenever bending length or sheet thickness is changed, which entails prolonged set-up time and increased cost due to a waste of test workpieces etc.

The second correction method (2) is intended to correct the deflection of the ram alone, but does not obtain the accurate distance between the upper and lower dies which distance actually affects the accuracy of bending, so that this method cannot accommodate variations in the thickness of a workpiece.

The third correction method (3) is based on the assumption that the pressure required for bending is proportional to the deflection of the apron (ram) and is designed to control the amount of pressure oil supplied to the deflection-correcting hydraulic cylinder by a control signal obtained from arithmetic operation. This method, therefore, fails in accurately correcting boat form in accordance with variations in the thickness of a workpiece.

The present invention has been made to overcome the foregoing problems and one of the objects of the invention is therefore to provide a bending machine which is capable of performing accurate in-line bending free from boat form, without making trial bends.

DISCLOSURE OF THE INVENTION

The above object can be achieved by a bending machine which bends a sheet-like workpiece to a desired angle by utilizing the relative movement of an upper die and a lower die, the bending machine comprising:

(a) angle detecting means provided on at least one side of a bending line of the workpiece, for detecting a bend angle at a plurality of detecting points located along the bending line of the workpiece;

(b) memory means for storing the difference between the bend angle detected at each detecting point by the angle detecting means during bending of the workpiece and a target bend angle for the workpiece;

(c) computing means for converting each angular difference stored in the memory means into the positional difference between the actual position of the upper or lower die and a target position for the upper or lower die;

(d) a plurality of bed driving means for driving at least either of beds, which support the upper die and lower die respectively, so as to cause deformation in the driven bed; and (e) controller means for controlling each of the bed driving means such that the bed driving means gives the driven bed a deformation amount corresponding to its associated positional difference obtained by the computing means.

According to the invention, after the upper die or lower die has been driven to a predetermined position, the angle of bend is detected by the angle detecting means at a plurality of points located along the bending line of the workpiece, and then the difference between each detected bend angle and a target bend angle for the workpiece is stored in the memory means. Thereafter, each of the angular differences stored in the memory means is converted into the difference between the actual position of the upper or lower die after driving and a target drive position. Each of the bed driving means is then controlled by the controller means such that the bed driving means gives the driven bed a deformation amount corresponding to its associated positional difference obtained by the computing means. Thus, the amount of opening at the center of the workpiece is automatically corrected by performing in-line bend angle detection, so that improved bend angle accuracy can be obtained throughout the bending line of the workpiece without making trial bends even if there are variations in the thickness of the workpiece.

In the invention, when continuously performing a series of bending operations with the same processing conditions, the controller means controls, in second and later bending operations, the bed driving means based on the deformation amounts for the bed obtained in a first bending operation which has been performed according to prestored data and processing conditions input by the operator. This ensures accurate boat form correction while reducing the time required for the cycles of bending operations.

In a preferred embodiment, a plurality of angle detecting means may be provided on each side of the bending line of the workpiece and these means are aligned along the bending line. In an alternative embodiment, the angle detecting means may be movable in a direction parallel to the bending line of the workpiece. Where a plurality of angle detecting means are used, bend angles can be detected on both sides of the bending line of the workpiece at the same time, which enables accurate calculation of the angular differences in the event that there occurs misalignment of the dies. The advantage of the use of the movable angle detecting means is that the angle of bend at a plurality of points located along the bending line on one side of the bending line can be detected by a single angle detecting means.

As the bed driving means, any one of the following devices may be used.

(1) A wedge mechanism for driving the driven bed by sliding a plurality of wedges inserted in the support section of the upper die or lower die.

(2) Linear actuators disposed on the ram to which the driven bed is attached.

(3) At least three hydraulic cylinders for lifting and lowering the ram to which the driven bed is attached.

(4) At least three motor-driven ball screws for lifting and lowering the ram to which the driven bed is attached.

Other objects of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

FIG. 1 is an elevational view.

FIG. 2 is a top plan view.

FIG. 3 is a sectional side elevation.

FIGS. 4(*a*) and 4(*b*) are flow charts of boat form correction control.

FIGS. 5(*a*) and 5(*b*) each show a graphical representation of a bend angle-ram bottom dead center characteristic curve.

FIG. 6 is a diagram concretely illustrating an example of boat form correction.

BEST MODE FOR CARRYING OUT THE INVENTION

Referring now to the accompanying drawings, a bending machine will be hereinafter described according to a preferred embodiment of the invention.

Figure 1:
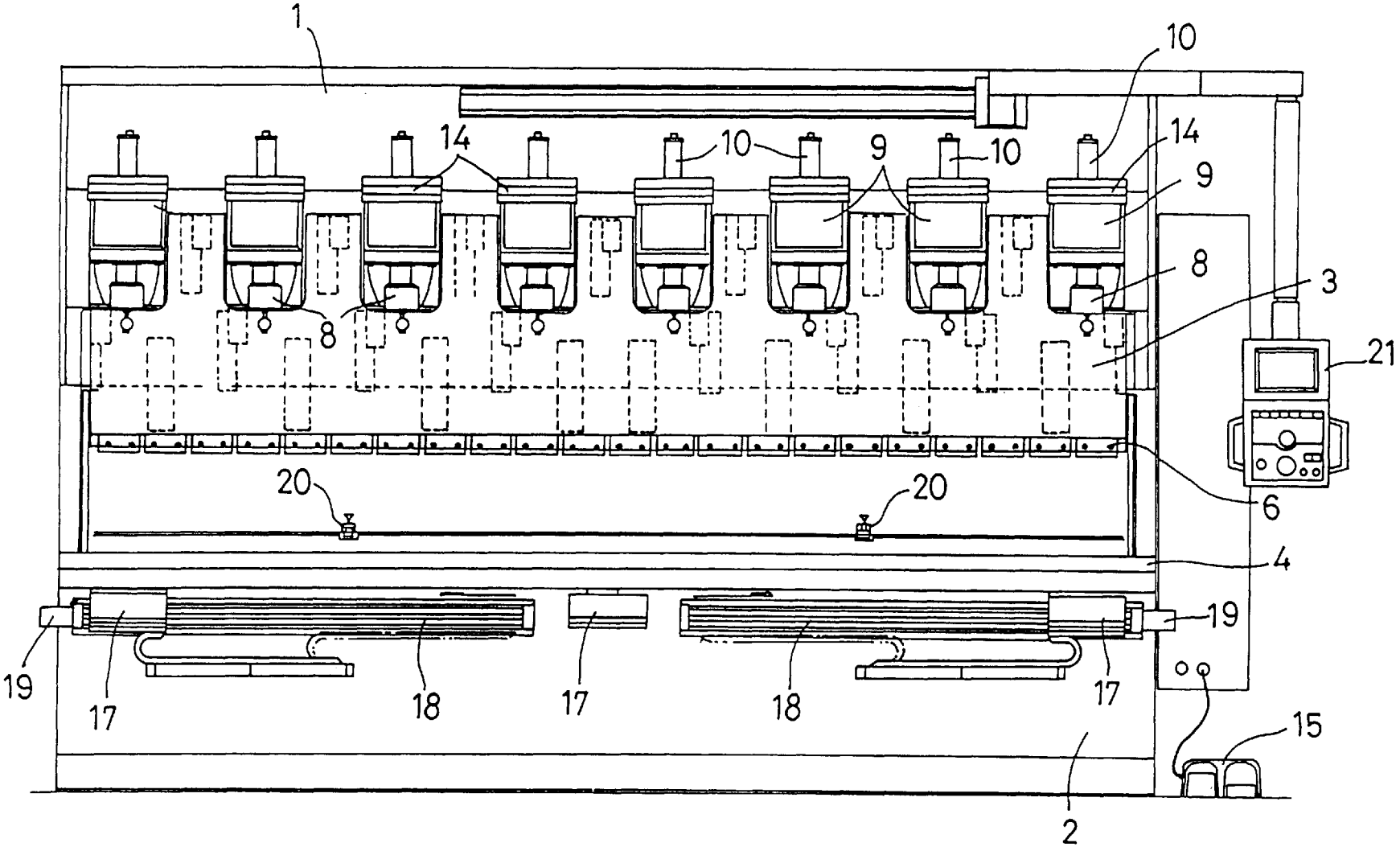
FIGS. 1 to 6 are associated with one preferred embodiment of the invention in which the invention is applied to a press brake.
Figure 2:
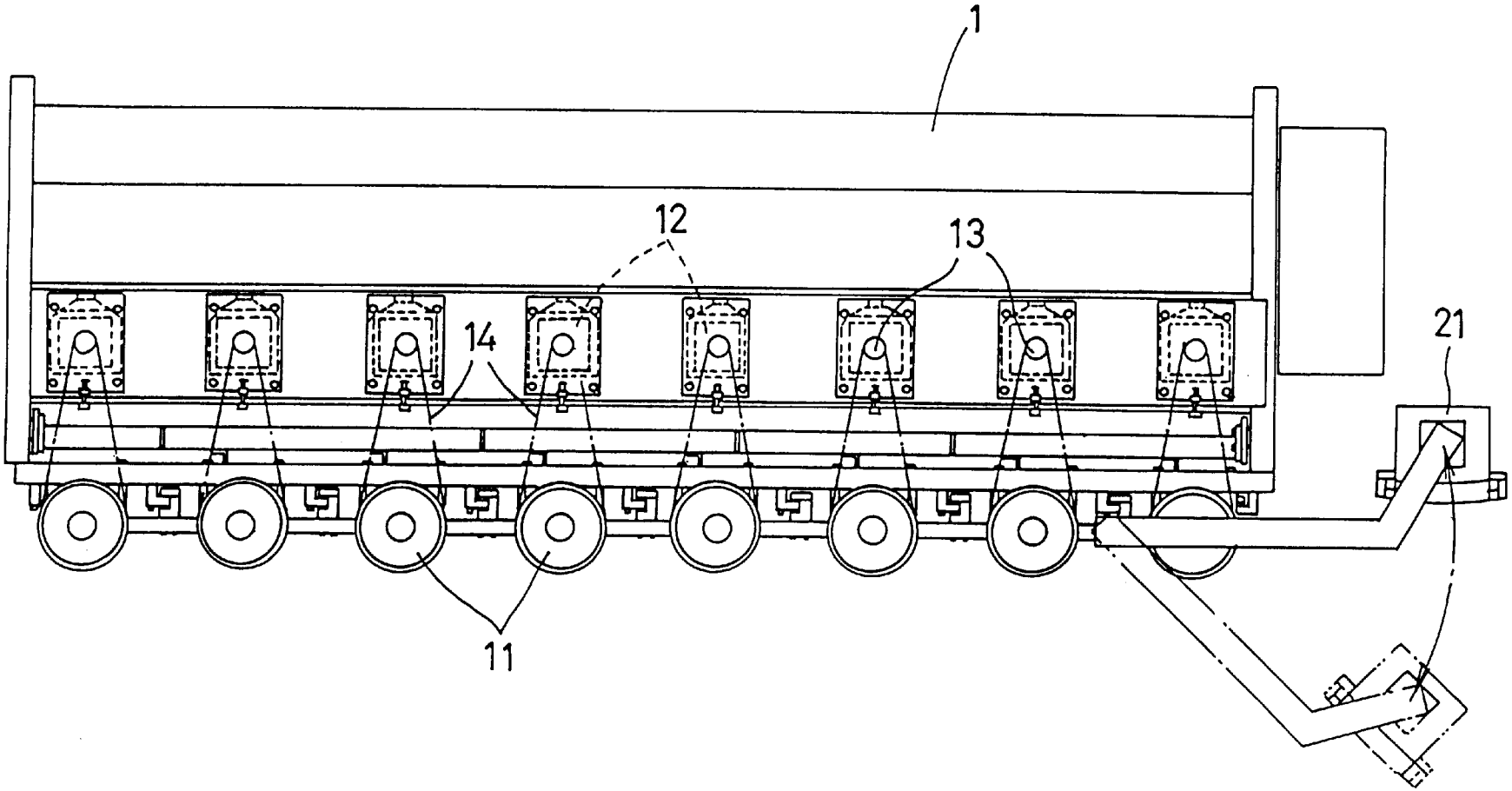
Figure 3:
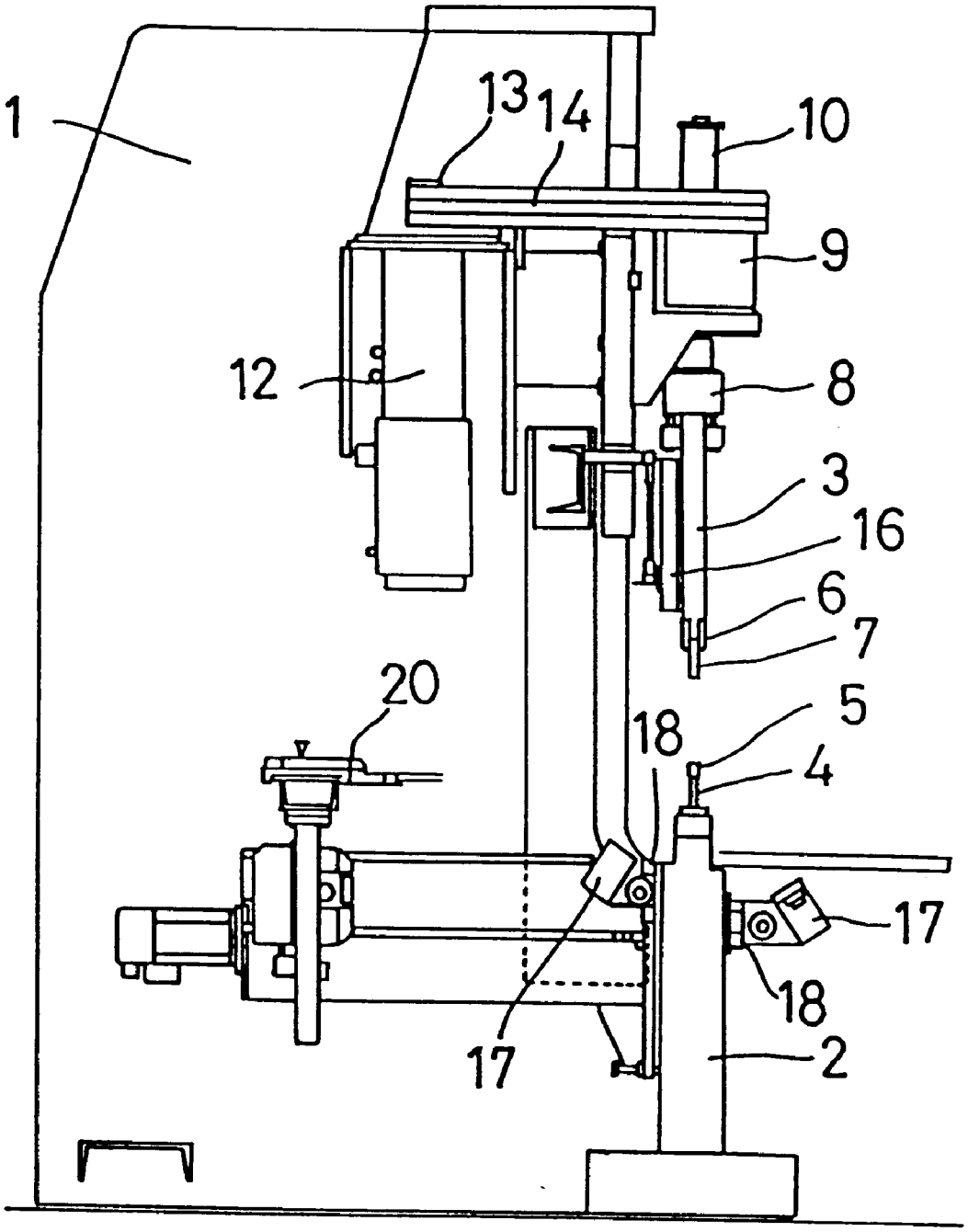

The elevational view, top plan view and sectional side elevation of a press brake according to the embodiment of the invention are shown in FIGS. 1, 2 and 3 respectively. In the press brake of this embodiment, there is provided a fixed table 2 on the front face of a machine body frame 1 so as to extend in the longitudinal direction of the machine body frame 1. A ram 3 is disposed opposite the fixed table 2 so as to be movable upward and downward. A lower die (die) 5 is mounted on the fixed table 2 with a lower bed 4 disposed therebetween, whereas an upper die (punch) 7 is attached to the lower end of the ram 3 with an upper bed 6 disposed therebetween.

The upper portion of the ram 3 is formed in a comb-teeth shape in which concave portions and convex portions are alternately aligned. A plurality of concave portions (8 concave portions in this embodiment) each have a ball nut 8 attached thereto. Each ball nut 8 has a ball screw 10 that is screwed into the ball nut 8 and rotatably supported by the machine body frame 1 through a bearing holder 9. Each ball screw 10 has a driven pulley 11 having a large bore. Wound around each driven pulley 11 and each driving pulley 13 attached to the motor shaft of each servo motor 12 is a timing belt 14.

By depressing a foot switch 15 to synchronously rotate the servo motors 12, the ball screws 10 are rotated synchronously so that the ram 3 is lifted or lowered in a horizontal condition. The moving amount of the ram 3 is detected by a linear encoder 16 disposed on the underside of the ram 3. Although this embodiment uses eight ball screws 10, the boat form of the workpiece can be corrected with at least three ball screws 10 which are disposed at the center and both ends of the ram 3.

The front face and rear face of the fixed table 2 are respectively provided with three angle detecting units 17. Of these six units, the central angle detecting units 17 on both faces are fixedly attached to the fixed table 2, whereas the right and left angle detecting units 17 on both faces are disposed so as to be laterally moved by driving motors 19 along guide rails 18 that are horizontally attached to the fixed table 2. By moving the right and left angle detecting units 17 along the guide rails 18, the angle of bend can be detected at three or more arbitrary points which are located along the bending line of the workpiece on each side of the bending line. Each of the angle detecting units 17 comprises, as described in Japanese Patent Laid-Open Publication No. 4-145315 (1992), (1) a light projecting means for projecting a slit light or a number of aligned spot lights onto the outer face of the bent workpiece, (2) a pick-up means for photographing a linear projected light image formed on the workpiece by the light projecting means, and (3) a computing means for obtaining the bend angle of the workpiece by processing the projected light image photographed by the pick-up means. The angle detecting units 17 in this embodiment are of the optical type (noncontact type) but other non-contact type systems or contact type systems may be employed as the angle detecting units 17. Examples of the non-contact type include the capacitance type, differential transformer type, and magnetic type.

A pair of back stoppers 20 are disposed behind the fixed table 2. The positions of the back stoppers 20 are adjustable by moving the back stoppers 20 in a back-and-forth direction as well as in a lateral direction so that they are brought into contact with the rear end face of the workpiece. Reference numeral 21 in FIGS. 1 and 2 designates an operation panel that is movable laterally and rockable back and forth relative to the machine body frame 1.

The correction of boat form of the workpiece by use of the press brake of the above structure is carried out with the eight servo motors 12 that generate major forces to be applied to the workpiece. In other words, the boat form correction can be carried out by independently controlling the eight ball screws 10 by the servo motors 12. Concretely, the correction is carried out in the following way. The ball screws 10 are synchronously driven to predetermined points respectively. At the respective points, the bend angle of the workpiece is detected by the angle detecting units 17. A correction amount for each ball screw 10 is calculated from the difference between the detected bend angle at its corresponding detecting point and a target angle for the workpiece, and then each ball screw 10 is driven by the corresponding correction amount.

Figure 4:
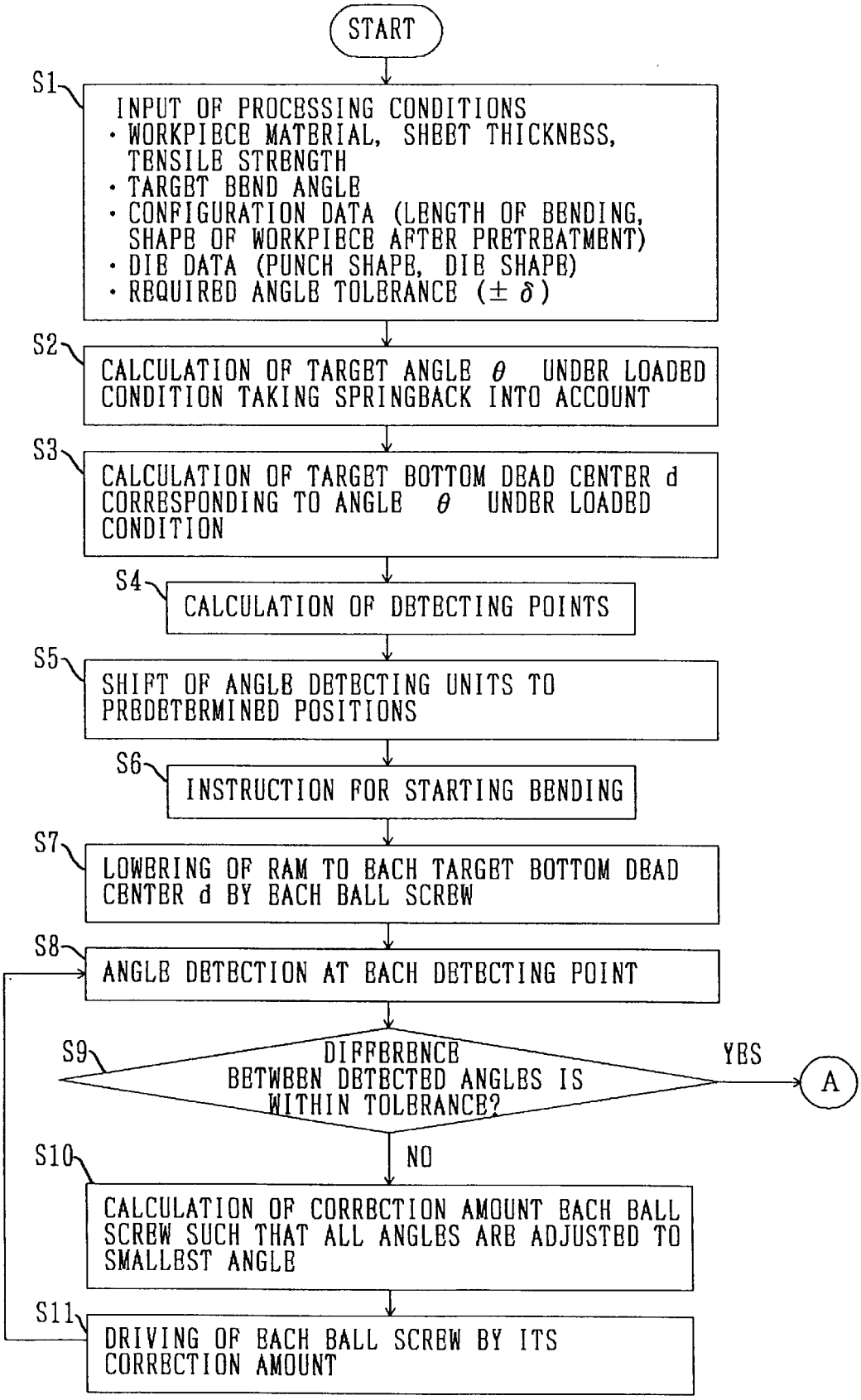
Figure 4:
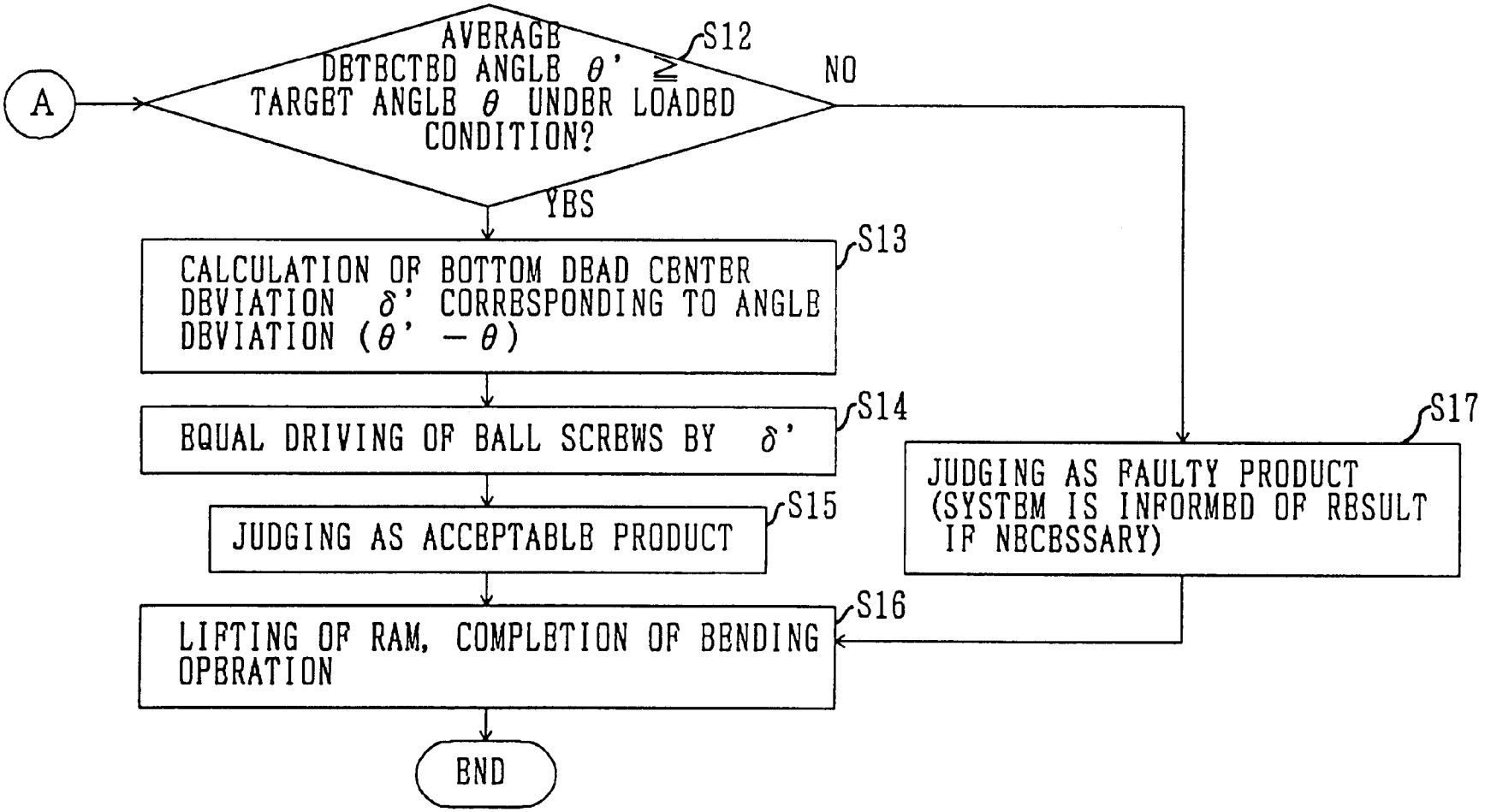

Reference is now made to the flow chart of FIG. 4 to more precisely explain the boat form correction.

S1 to S3: For starting a bending operation, the following bending conditions are input.

(1) workpiece material, sheet thickness, tensile strength (2) target bend angle (3) configuration data (length of bending, shape of workpiece after pretreatment)

(4) die data (punch shape, die shape)

(5) required angle tolerance ($\pm\delta$)

Figure 5:
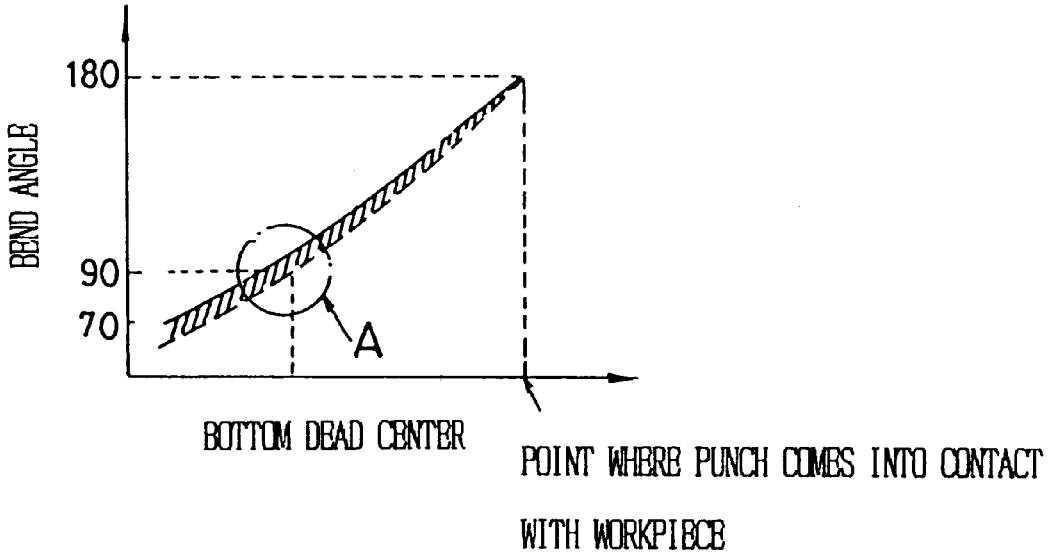
Figure 5:
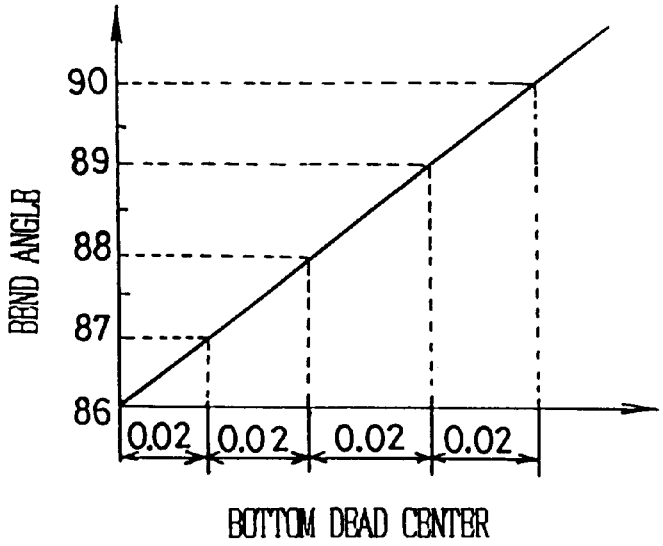

It should be noted that there are prestored data representative of the relationship between the bottom dead center d for the ram, the angle of bend $\theta$ and the angle of springback according to bending conditions (e.g., workpiece material, sheet thickness, die conditions) in the memory of the NC device. One example of the data stored in the NC device is shown in FIG. 5. In FIG. 5(*a*), the solid line represents the relationship between the angle of bend and the bottom dead center when the workpiece is stressed by the punch and die (this condition is hereinafter referred to as "loaded condition"), whereas the chain line represents the relationship between the angle of bend and the bottom dead center after the workpiece is released from the stress (this condition is hereinafter referred to as "unloaded condition"). The hatched region between the solid line and the chain line is data representative of the angle of springback (i.e., springback data). FIG. 5(*b*) shows, in an enlarged form, the region A (shown in FIG. 5(*a*)) of the angle of bend-bottom dead center curve when the workpiece is in the loaded condition. As seen from FIG. 5(*b*), a small part of the angle of bend-bottom dead center curve can be approximated by a straight line.

In the NC device, the target angle $\theta$ for the workpiece in the loaded condition is calculated taking account of the angle of springback, based on the input data on various bending conditions and the prestored data, and the target bottom dead center d corresponding to the target angle $\theta$ is automatically calculated. It is widely known that the final bend angle obtained after bending operation often varies because the physical properties (Young's modulus, yield point etc.) and thickness of the material used vary within their tolerances. Therefore, the target bottom dead center d is usually determined, taking such variations into account, so as not to cause overbend.

S4 to S5: The NC device determines detecting points from the input data on workpiece configuration, and the angle detecting units 17 are respectively moved to the determined detecting points by driving the motors 19. In cases where the bend program is stored in an NC tape or the like, the steps SI to S5 are automatically executed according to the stored bend program.

S6 to S7: After the foot switch 15 has been depressed to instruct a start of a bending operation, the ram 3 is lowered to the bottom dead center d by the ball screws 10 and stopped thereat.

S8 to S11: Upon receipt of an instruction for angle detection, each angle detecting unit 17 detects the bend angle of the workpiece at each predetermined detecting point. If the difference between the bend angles detected by the angle detecting units 17 exceeds the allowable range, the smallest bend angle value is selected from the detected bend angles. Correction amounts for the respective ball screws 10 are calculated based on the selected detected bend angle and the ball screws 10 are driven by their respective correction amounts. Thereafter, the angle of bend is again detected at each detecting point. This repetitive process is continued until the difference between detected bend angles falls within the allowable range.

Figure 6:
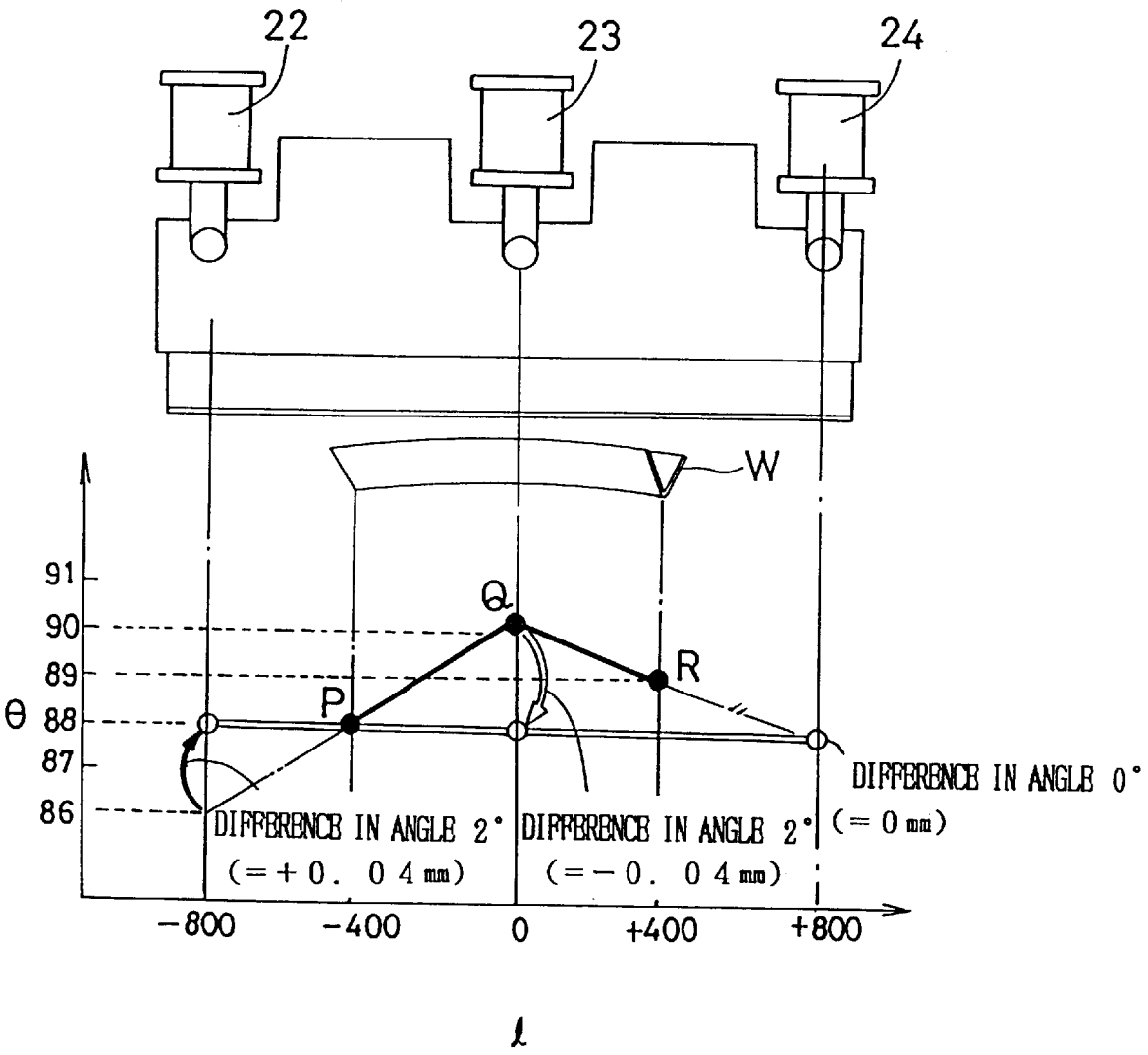

These steps will be more concretely explained through an example. Suppose that a workpiece W having a length of 800 mm is bent to 90° by a press brake that has, as diagrammatically illustrated in FIG. 6, ram driving units 22, 23, 24 spaced 800 mm apart. In this example, the angle of springback is 3°, the target angle for the workpiece in the loaded condition is 87°, and the target bottom dead center corresponding to this target angle is d. As mentioned earlier, the bottom dead center is determined so as not to cause overbend and therefore the bend angle obtained with this bottom dead center is smaller than the target bend angle 87°. If variations in the bend angle of the workpiece W due to deformation of the bending machine or the like are as illustrated in the graph of FIG. 6, correction driving amounts for the ram driving units 22, 23, 24 are determined such that bend angles to be detected at all the detecting points after correction are equal to be the smallest angle obtained in the detection before correction (i.e., 88° at the detecting point P in this example). Concretely, the correction amount for the ram driving unit 22 (positioned at the left end of the ram) is determined so as to obtain a bend angle that is 2° larger than the bend angle obtained by the driving amount for the unit 22 before correction. The correction amount for the ram driving unit 23 (positioned at the center of the ram) is determined so as to obtain a bend angle that is 2° smaller than the bend angle obtained by the driving amount for the unit 23 before correction. The correction amount for the ram driving unit 24 (positioned at the right end of the ram) is determined so as to maintain the bend angle obtained by the driving amount for the unit 24 before correction. Based on the above data and the data shown in FIG. 5(*b*), the correction amounts for the ram driving units 22, 23, 24 are +0.04 mm (lifting), −0.04 mm (lowering) and 0 mm (maintaining), respectively.

S12 to S17: If the difference between the detected bend angles falls within the allowable range, it means that variations in the angle of bend according to positions over the bending line of the workpiece W caused by deformation of the bending machine or the like have been eliminated. Then, the average value $\theta'$ of the detected bend angles is compared with the target bend angle $\theta$ for the workpiece in the loaded condition. If $\theta' \geqq \theta$ is satisfied, the bottom dead center deviation $\delta'$ corresponding to the bend angle deviation $\theta'-\theta$ is calculated to uniformly drive the ball screws 10 by $\delta'$. Taking the case shown in FIG. 6 for example, the bend angle (88°) of the workpiece W at each position has not reached the target bend angle of 87° set for the workpiece W in the loaded condition, and therefore each of the ram driving units 22, 23, 24 needs to be further lowered by 0.02 mm that corresponds to 1°. The ram driving units 22, 23, 24 can be driven simply by the same amount at this stage for the following reason. In typical bending operation, bending load does not vary significantly except for in the very initial stage because bending load is not affected by deformation of the bending machine or the like, as far as it is a minute value. After the ball screws 10 are thus driven equally, the bent article is regarded as an acceptable product so that the ram 3 is lifted to complete the bending operation.

If $\theta' < \theta$ is satisfied, the bent article is regarded as a faulty product and the system is informed of the result if necessary. Then, the ram 3 is lifted to complete the bending operation.

The above embodiment has been described with a case where the bend angle detection by the angle detecting units 17 is carried out when the workpiece is under the loaded condition. However, it is also possible to detect the bend angle of the workpiece under the unloaded condition provided that the workpiece can be supported even if the movable die is separated from the workpiece and to use the difference between the detected bend angle of the workpiece under the unloaded condition and a target bend angle, for driving the ram 3. The advantage of this arrangement is that less driving force is required for driving the ram 3.

By virtue of the boat form correction described in the above embodiment, satisfactory bend angles with deviation falling within a tolerance can be ensured over the bending line of the workpiece, without involving troublesome steps such as making of trial bends. As a result, bending of an elongate workpiece, which is generally regarded as difficult operation, can be accurately performed.

Although springback angle variations are not taken into account in the above embodiment, the following steps may be added when bending a material which entails significant variations in the angle of springback: (1) the workpiece is once unloaded in the final step; (2) the angle of springback is obtained from the bend angle measured after unloading; and (3) correction is made again with the angle of springback thus obtained.

When continuously performing a series of bending operations with the same processing conditions, it takes a lot of time to perform the calculation of correction amounts as shown in the flow chart for every bending operation. Therefore, it is desirable in such a case to control the ball screws based on the correction amounts obtained in the initial operation that has been performed with the input processing conditions and the prestored data. This arrangement enables a reduction in the time required for the cycles of bending operations and enables accurate boat form correction.

While the position of the ram is controlled by the ball screws in the above embodiment, at least three hydraulic cylinders for generating major pressing force may be used in controlling the ram's position in place of these ball screws.

While the boat form correction is carried out by directly controlling the position of the ram in the above embodiment, a subsidiary driving means such as pressure oil may be used for deforming the ram. In this case, it is desirable that the relationship between hydraulic force and the deformation amount of the ram is prestored in the memory as mechanical characteristic data based on which pressure control etc. is performed.

Figure 7:
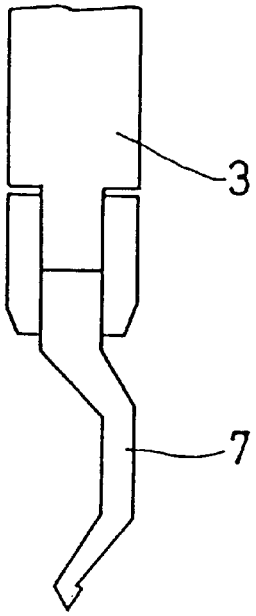
FIG. 7 is a side view of an alternative embodiment of the invention.
Figure 7:
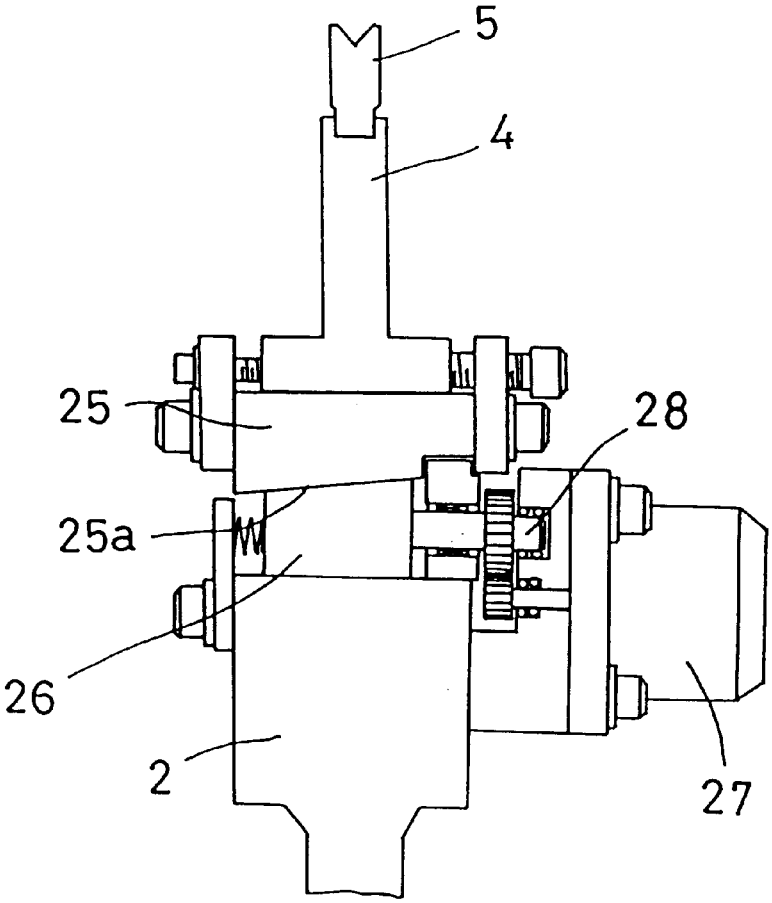
Figure 8:
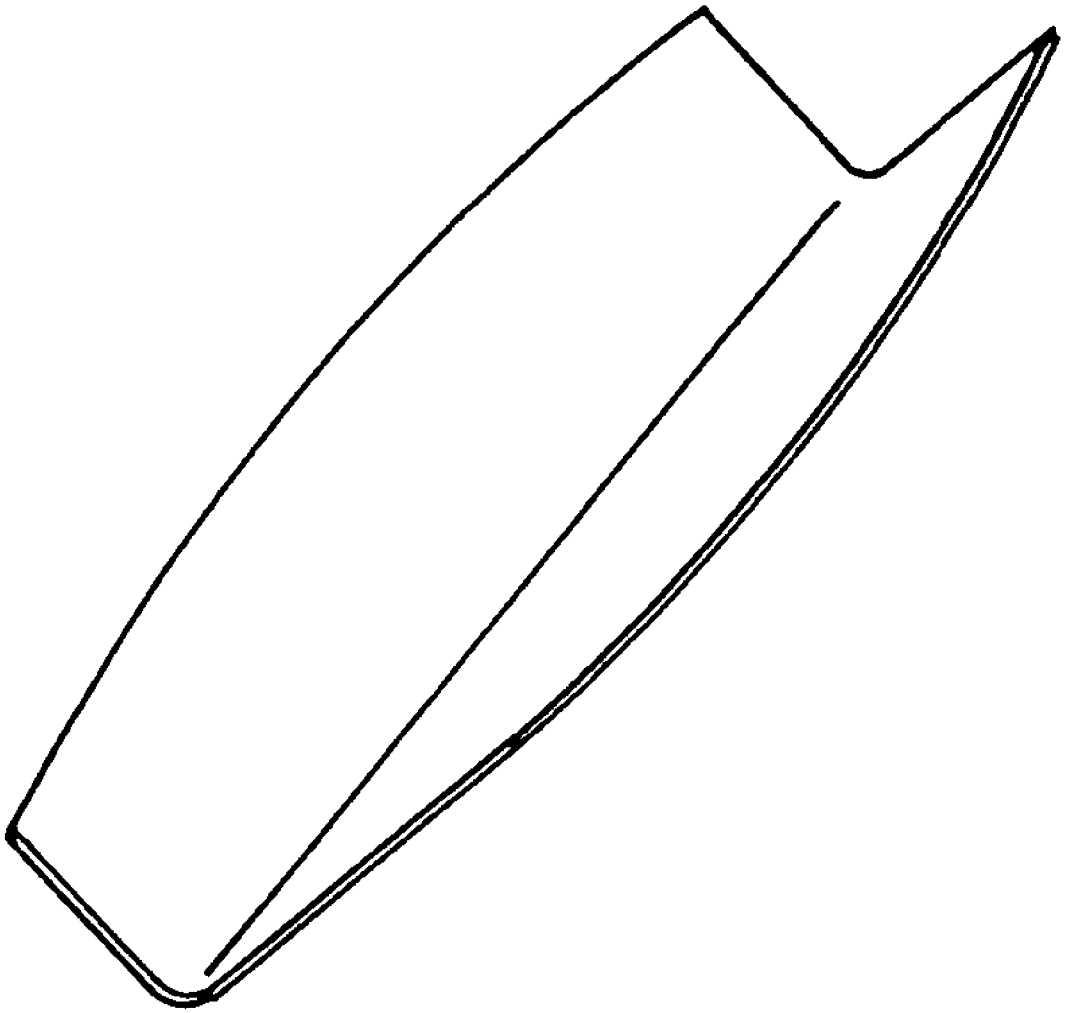
FIG. 8 illustrates boat form in a workpiece.

An alternative embodiment employs a wedge mechanism. This mechanism is provided in the support section of the lower die (or upper die), as shown in FIG. 7. In the embodiment shown in FIG. 7, there are provided, between the fixed table 2 and the lower bed 4, a plurality of thrust supporting members 25 each having an inclined face 25*a* at its underside. Provided between the thrust supporting members 25 and the top face of the fixed table 2 are a plurality of wedge-like keys 26. The wedge-like keys 26 are respectively driven through reduction gear mechanisms 28 by means of driving power sources 27 such as servo motors or stepping motors such that the keys 26 slide laterally on the plane of the drawing. The vertical position of the die 5 can be controlled by independently driving each driving power source 27 corresponding to each wedge-like key 26.

While there are provided three angle detecting units 17 on each side of the bending line of the workpiece in the above embodiment, each side of the bending line may be provided with one angle detecting unit 17 which travels along the entire bending line to detect the bend angle of the workpiece at a plurality of points. It is, of course, possible to provide four angle detecting units 17 on each side. In another alternative, only one side is provided with the angle detecting unit(s) 17. In this case, bend angle detection is carried out at one side of the bending line and bend angles at the other side are estimated from the values obtained from one side.

While the above embodiment has been described with an over-drive type press brake in which the upper die is driven while the lower die being stationary, the invention is applicable to under-drive type press brakes in which the lower die is driven while the upper die being stationary and to press brakes in which the upper and lower dies are both driven.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A bending machine which bends a sheet-like workpiece to a desired angle by utilizing the relative movement of an upper die and a lower die, the bending machine comprising:

(a) angle detecting means provided on at least one side of a bending line of the workpiece, for detecting a bend angle at a plurality of detecting points located along the bending line of the workpiece while the upper and lower dies are bending the workpiece;

(b) memory means for storing the difference between the bend angle detected at each detecting point by the angle detecting means during bending of the workpiece and a target bend angle for the workpiece;

(c) computing means for converting each said angular difference stored in the memory means into the positional difference between the actual position of the upper or lower die and a target position for the upper or lower die;

(d) a plurality of bed driving means for driving at least either of beds, which support the upper die and lower die respectively, so as to cause deformation in the driven bed; and (e) controller means for controlling each of the bed driving means such that the bed driving means gives the driven bed a deformation amount corresponding to its associated positional difference obtained by the computing means.

2. A bending machine according to claim 1, wherein when continuously performing a series of bending operations with the same processing conditions, the controller means controls, in second and later bending operations, the bed driving means based on the deformation amounts for the driven bed obtained in a first bending operation which has been performed according to prestored data and input processing conditions.

3. A bending machine according to claim 1, which has a plurality of angle detecting means on each side of the bending line of the workpiece, said means being aligned along the bending line.

4. A bending machine according to any one of claims 1 to 3, wherein said angle detecting means is movable in a direction parallel to the bending line of the workpiece.

5. A bending machine according to claim 1, wherein said bed driving means are a wedge mechanism for driving said driven bed by sliding a plurality of wedges disposed on the support section of the upper die or lower die.

6. A bending machine according to claim 1, wherein said bed driving means are linear actuators disposed on the ram having said driven bed attached thereto.

7. A bending machine according to claim 1, wherein said bed driving means are at least three hydraulic cylinders for lifting and lowering the ram having said driven bed attached thereto.

8. A bending machine according to claim 1, wherein said bed driving means are at least three motor-driven ball screws for lifting and lowering the ram having said driven bed attached thereto.

9. A bending machine according to claim 1, wherein upper die is formed having alternatively concave and convex portions, and each concave portion is independently driven.

10. A bending machine according to claim 1, wherein the upper die is formed of a plurality of independently movable elements.

* * * * *